United States Patent [19]

Gabrys

[11] Patent Number: 4,846,374

[45] Date of Patent: Jul. 11, 1989

[54] TAMPER RESISTANT END CLOSURE FOR CONTAINERS

[75] Inventor: Ronald B. Gabrys, Wisconsin Rapids, Wis.

[73] Assignee: Consolidated Papers, Inc., Wisconsin Rapids, Wis.

[21] Appl. No.: 194,036

[22] Filed: May 13, 1988

Related U.S. Application Data

[63] Continuation-in-part of Ser. No. 62,100, Jun. 15, 1987, abandoned.

[51] Int. Cl.[4] ..... B67B 5/00

[52] U.S. Cl. ..... 222/153; 222/142.9; 222/480; 222/548; 222/565; 220/253; 220/265; 53/410; 53/489; 403/408.1; 411/45

[58] Field of Search ..... 222/153, 480, 142.6–142.9, 222/541, 548, 565; 53/489, 410; 493/962; 138/89; 411/44, 45; 215/279, 358; 403/408.1, 71, 290, 388; 220/253–258, 307, 359, 235, 237, 238, 86 AT, DIG. 19

[56] References Cited

U.S. PATENT DOCUMENTS

| | | | |
|---|---|---|---|
| 2,569,162 | 9/1951 | Gowland | 222/548 |
| 2,605,028 | 7/1952 | Nyden et al. | 222/542 |
| 2,660,344 | 11/1953 | Starner | 222/548 |
| 2,817,451 | 12/1957 | Giles et al. | 222/480 X |
| 3,525,365 | 8/1970 | Meulendyk et al. | 215/358 X |
| 3,697,110 | 10/1972 | Portz et al. | 403/388 X |
| 3,884,382 | 5/1975 | Ball | 53/489 X |
| 4,002,516 | 1/1977 | Gaborieau et al. | 215/358 X |
| 4,274,563 | 6/1981 | Otterson | 222/480 |
| 4,352,589 | 10/1982 | Allison et al. | 403/388 X |
| 4,541,541 | 9/1985 | Hickman et al. | 220/480 X |
| 4,567,995 | 2/1986 | Kreiseder et al. | 220/253 |
| 4,598,837 | 7/1986 | Kreiseder et al. | 220/253 |
| 4,611,725 | 9/1986 | Kacalieff | 220/253 |

*Primary Examiner*—Joseph J. Rolla
*Assistant Examiner*—Gregory L. Huson
*Attorney, Agent, or Firm*—Juettner Pyle Lloyd & Verbeck

[57] ABSTRACT

A tamper resistant end closure for a container includes a base for closing an end of the container and a rotor pivotally connected to the base by a hub in the form of a hollow stem extended through a center opening in the base. An annular flange at the lower end of the stem retainably engages a lower surface of the base, and a plug is driven into and bonded within the stem, after the rotor is connected to the base, to inhibit removal of the rotor by preventing radially inward movement of the flange. The rotor and plug may initially be integral, such that an end of the plug is attached by a frangible web to the rotor, at an end of and in alignment with the passage through the stem. The frangible web is broken when the plug is driven into the stem.

25 Claims, 2 Drawing Sheets

TAMPER RESISTANT END CLOSURE FOR CONTAINERS

This is a continuation-in-part of copending application Ser. No. 62,100 filed on June 15, 1987 and now abandoned.

BACKGROUND OF THE INVENTION

The present invention relates to end closures for containers and the like, and in particular to a tamper resistant end closure having a rotary top.

Various types of containers and closures have been developed for dispensing foods, condiments and similar products. One of the more popular closure designs from a convenience point of view is the rotary top closure having multiple openings, commonly used for dispensing granulated foods and flavorings.

A rotary top closure includes two major elements, a rotor and a base. The base is attached to an end of a cylindrical or rectangular container by any suitable means, such as by an adhesive or friction fit. The base comprises a web portion having one or more openings through which the contents of the container may be dispensed. Normally, to preserve freshness and provide an indication of product integrity, the dispensing openings are initially covered by a removable tab portion of the web, which can be pushed out by the consumer to open the container. The rotor also includes a web portion having one or more openings that may be aligned with the base openings when the rotor is manually rotated. The rotor may be pivotally attached to the base by a hub or stem that extends through a central opening in the base and forms a snap or friction fit between the base web and hub.

A removable base tab that has been pushed in will provide a visual indication that a container has been opened. However, with conventional containers there is often no readily perceivable indication that the base and rotor may have been pulled apart and separated. When the rotor is pulled off the base, the contents of the container may be adulterated through the central opening in the base web and the rotor reinstalled with no indication that the container was tampered with.

OBJECTS OF THE INVENTION

An object of the invention is to provide an improved rotary end closure for containers, which is both tamper resistant and convenient to use.

Another object is to provide such an end closure, that is rendered unusable in its normal operating manner when tampered with so as to contaminate the container contents.

A further object is to provide such an end closure, in which a rotor is mounted on a base in a manner to preclude removal of the rotor from the base without destruction of one or the other.

SUMMARY OF THE INVENTION

In accordance with the present invention, an improved end closure has a base and a rotor pivotally connected to the base by a hub of the rotor extending through an opening in the base. The base and rotor have webs with respective dispensing apertures therein, and a rotor dispensing aperture is alignable with a base dispensing aperture by pivotal movement of the rotor with respect to the base about the axis of the hub. The hub extends perpendicularly from the rotor web and has an axial passage therethrough and an annular flange therearound spaced from the rotor web, the annular flange has a diameter greater than that of the base opening and the hub, between the flange and rotor web, has a diameter less than that of the flange. The rotor is assembled on the base by extending the hub and its flange through the base opening, such that the hub and flange collapse radially inwardly into the hub passage as the flange is moved through the opening and then return radially outwardly as the flange moves out of the opening, whereby the flange secures the rotor to the base with the two in close, superposed relationship. The improvement is characterized by a plug extended into and substantially completely filling the hub passage of the assembled rotor and base combination, thereby to prevent radially inward collapse of the hub and flange into the hub passage upon any attempt to remove the rotor from the base. Advantageously, the rotor and plug are initially integral, such that an end of the plug is attached by a frangible web to the rotor web at an end of and in alignment with the passage through the hub. The frangible web is broken when the plug is extended into the hub passage.

The foregoing and other objects, advantages and features of the invention will become apparent upon a consideration of the following detailed description, when taken in conjunction with the accompanying drawings.

DETAILED DESCRIPTION

Figure 1:
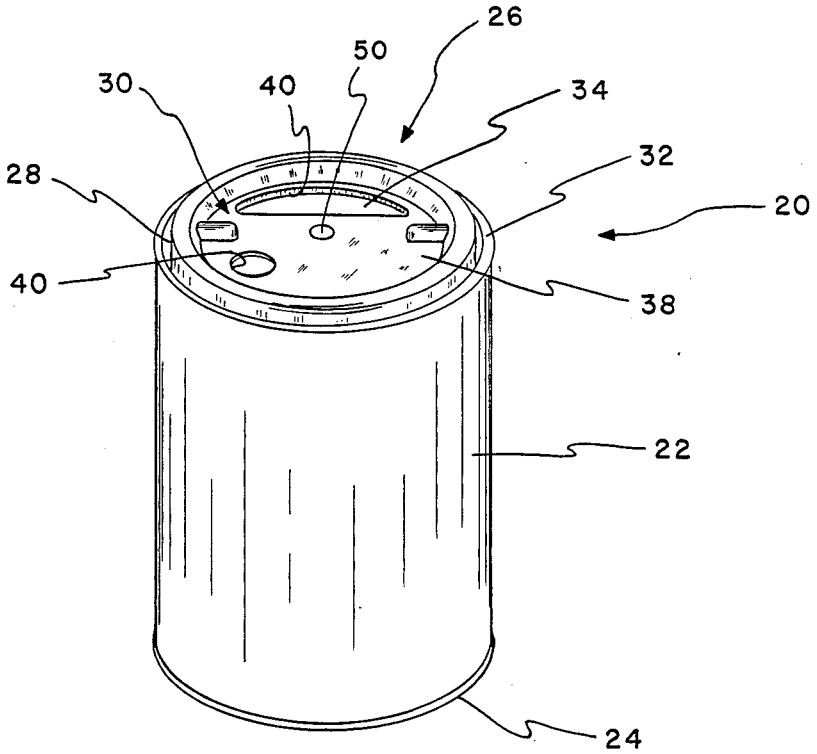
FIG. 1 is a perspective view of a container having a tamper resistant end closure according to the present invention.

A container for granulated food products and condiments is shown in FIG. 1 and indicated generally at 20. The container is cylindrical in shape and has a wall portion 22, a bottom end cap 24 and a rotatable top end closure, indicated generally at 26, for dispensing the contents of the container. The closure includes a base 28 and a rotor, indicated generally at 30, pivotally attached to the base. The rotor is usually made of a plastic material, and the base of a plastic material or a light gauge deformable metal. The base has an outer annular skirt 32 that engages and is secured in a sealed manner with an upper outlet end of the container wall. The base is therefore in sealed engagement with the container to prevent leakage, spoilage or contamination of its contents.

Figure 2:
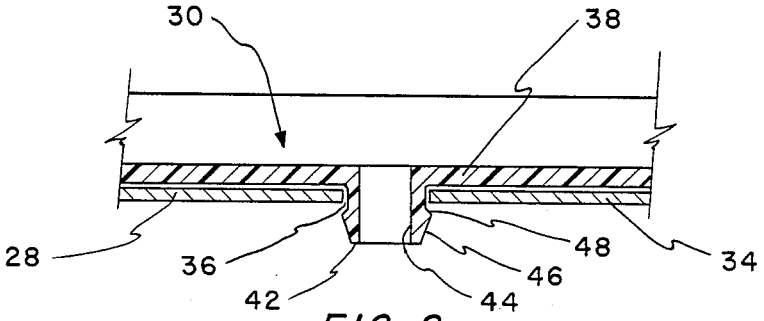
FIG. 2 is a cross-sectional view of the center portion of the end closure, showing a hub of a rotor extended through a central opening of a base.
Figure 3:
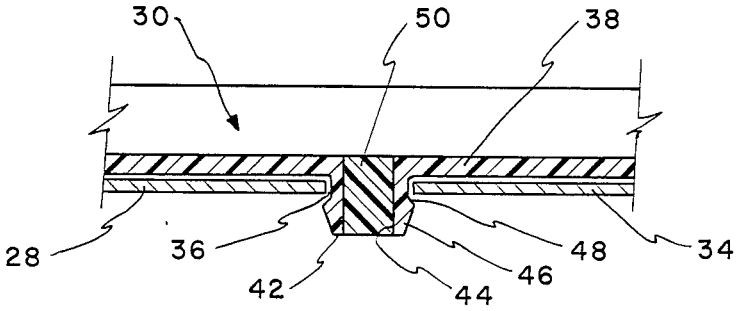
FIG. 3 is similar to FIG. 2, except that a plug is installed within a passage through the hub to prevent removal of the rotor from the base without damage to one or the other.

Referring also to FIGS. 2 and 3, within the skirt 32 the base 28 includes a thin web membrane 34 extending over the upper dispensing end of the container wall 22. As is conventional, the web is provided with one or more dispensing means (not shown) through which contents of the container can be dispensed. The dispensing means comprise one or more pushout tabs (not shown), each defined by a perimeter that has a substantially reduced web thickness, so that each is easily breakable by manual force exerted thereon in a direction toward the interior of the container to establish one or more apertures in the web. The sizes and shapes of the apertures are a matter of choice, depending upon the particular dispensing arrangement required. The web also has a round opening 36 which is located centrally of the web and receives a portion of the rotor 30 for the purpose of assembling the rotor and base together, as will be described.

The rotor 30 is a disc-like member having a web portion 38 provided with one or more openings 40 that are alignable with the tabs or apertures formed in the base web 34 by pivotal movement or rotation of the rotor. The rotor is pivotally attached to and held in close, parallel, superposed relationship to the base by a circular hollow hub or stem 42, which as illustrated is coaxial with the center of the rotor. Rotation of the rotor about the longitudinal axis of the hub allows the apertures in the web of the base to either be open by alignment of the rotor openings with the base apertures, or closed by covering the base apertures with a solid portion of the rotor web, as is well known in the art.

The stem or hub 42 is integrally formed with the rotor web 38, it has a passage 44 of generally uniform diameter axially therethrough, and it extends through the opening 36 in the base web 34 with a slight radial clearance when the rotor 30 and base 28 are in assembled, superposed configuration. An annular flange 46 is formed on the free end of the stem, and provides a shoulder 48 that retainably engages the underside of the base web about the periphery of the opening. The flange defines the major diameter of the stem, and has a diameter slightly larger than that of the opening, so that upon assembly of the rotor to the base by pushing the stem through the opening, the flange and stem body collapse radially inwardly into the stem passage as the flange passes through the opening and then expand radially outwardly as the flange exits the passage to lock the stem to the base. A snap fit arrangement between the rotor and base is therefore achieved while still allowing the rotor to pivot about the axis of the stem, with the stem then retaining the rotor and base in close, superposed relationship.

To the extend described, the design of the end closure 26 is generally conventional, and while the absence of any tabs on the base web 34 having been pushed down to establish apertures provides some assurance to the end user that the contents have not been tampered with, it is nevertheless possible with the conventional design to pull the rotor 30 apart from the base 28 to gain access to the container contents through the base center opening 36. After the contents have been adulterated, the rotor could then be reinstalled onto the base and the unit would appear and operate as normal.

Accordingly, to prevent removal of the rotor 30 from the base 28 without rendering the end closure 26 nonfunctional, the invention contemplates, as seen in FIG. 3, that after the rotor stem 42 is pushed through the base opening 36 to establish a snap fit between the rotor and base, a cylindrical plug 50 be pressed into and secured within the stem passage 44. For a snug press fit, the plug advantageously has a diameter slightly greater than that of the stem passage, and may be bonded within the passage to prevent its removal. The plug completely fills the space into which the stem and flange collapsed as the flange was pressed into and through the base opening 36, without significantly expanding the stem and flange radially outwardly, and prevents any subsequent collapse of the stem and flange into the passage space if an attempt is made to pull the rotor from the base to gain access to the container contents through the base opening. Should pulling pressure increase beyond the strength of the stem and/or base material, the stem will tear off of the rotor, the base material will tear and/or the base will be deformed, rendering the end closure non-functional and providing a visual indication that the container contents may have been tampered with.

Figure 4:
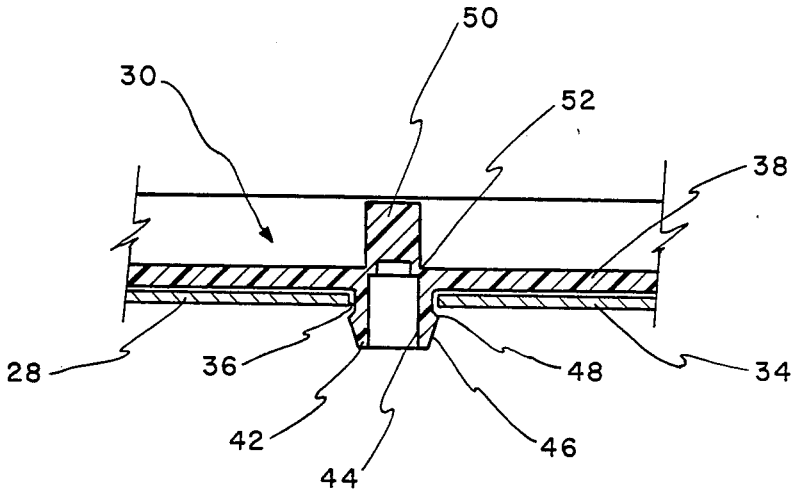
FIG. 4 is similar to FIG. 2, except that the rotor and plug are initially integral and attached by a frangible web.

The rotor 30 and cylindrical plug 50 may initially be formed as separate parts. However, to facilitate handling of the same and insertion of the plug into the passage 44 of the rotor stem 42, the rotor and plug are advantageously initially fabricated as an integral component. To that end, and as seen in FIG. 4, in their initial integral form a lower end of the cylindrical plug 50 is attached by a frangible web 52 to the rotor web 38 around an upper end of the stem passage 44, such that the plug is coaxial and aligned with the passage. A centrally located circular recess 54 is in the lower end of the plug, and the plug has a diameter slightly greater than that of the stem passage. The frangible web holds the plug in alignment for being pressed into the stem passage after the stem is extended through the center opening 36 in the base 28. With the stem extended through the base opening and the lower part of the stem supported, sufficient pressure is applied to the top of the plug to break or fracture the frangible web and move the plug into press fit relationship in the stem passage, with the circular recess 54 providing a relieved area to facilitate initial movement of the plug into the passage. The plug then fills the passage space into which the stem and flange 46 collapsed as the same were pressed into and through the base opening, and prevents any radially inwardly movement of the stem and flange if an attempt is made to pull the rotor from the base to gain access to the container contents through the base opening.

While embodiments of the invention have been described in detail, various modifications and other embodiments thereof may be devised by one skilled in the art without departing from the spirit and scope of the invention, as defined in the appended claims.

What is claimed is:

1. An improved end closure having a base and a rotor pivotally connected to said base by a hub of said rotor extending through an opening in said base, said base and rotor having webs with respective dispensing apertures therein and said rotor dispensing aperture being alignable with said base dispensing aperture by pivotal movement of said rotor with respect to said base about the axis of said hub, said hub extending perpendicularly from said rotor web and having an axial passage of generally uniform diameter therethrough and an annular flange therearound spaced from said rotor web, said annular flange having a diameter greater than that of said base opening and said hub, between said flange and rotor web, having a diameter less than that of said flange, said rotor being assembled on said base by pushing said hub and flange thereof through said base opening, said hub and flange collapsing radially inwardly into said hub passage as said flange is moved through said base opening and then returning radially outwardly as said flange moves out of said base opening, whereby said flange secures said rotor to said base with the two in close superposed relationship, wherein the improvement is characterized by a plug extended into and substantially completely filling said hub passage of the assembled rotor and base, without causing significant radially outward expansion of said hub and flange, to prevent radially inward collapse of the hub and flange upon any attempt to pull the rotor from the base.

2. An improved end closure as in claim 1, wherein said plug is bonded in said hub passage.

3. An improved end closure as in claim 1, wherein said plug has a length substantially equal to that of said hub passage.

4. An improved end closure as in claim 1, wherein said plug has a diameter substantially equal to that of said hub passage.

5. An improved end closure as in claim 1, wherein said plug has a diameter slightly greater than that of said hub passage for a tight press fit of said plug in said passage.

6. An improved end closure as in claim 1, wherein said rotor is of a plastic material.

7. An improved end closure as in claim 1, wherein said plug and rotor are initially integral and an end of said plug is attached by a frangible web to said rotor at an end of said hub passage with said plug in alignment with said passage for extension therein, said frangible web being adapted to break upon extension of said plug into said hub passage.

8. A tamper resistant end closure for a container, comprising a base and a rotor pivotally connected to said base, said base having a web portion with an opening therein and means defining at least one dispensing aperture, said rotor having a web portion and a stem attached at one end to said rotor web, the free end of said stem extending through said opening in said base web, said stem free end having retaining means for slidably engaging said base web around the periphery of said opening and retaining said base and rotor in a close, superposed relationship, said rotor having at least one opening in said rotor web alignable with said base dispensing aperture when said rotor is pivoted about the axis of said stem, said stem having an axial passage of generally uniform diameter therethrough and through said rotor web to accommodate radially inward movement of said stem and retaining means as the same are extended through said base opening to connect said rotor to said base, and including a plug extended into and substantially completely filling said stem passage of said assembled rotor and base, without causing significant radially outward expansion of said stem and retaining means, to prevent radially inward movement of said stem and retaining means upon any attempt to pull said stem out of said base opening and to thereby prevent disconnection of said rotor from said base.

9. An end closure as in claim 8, wherein said plug is bonded in said stem passage.

10. An end closure as in claim 8, wherein said plug has a diameter slightly greater than that of said stem passage for a tight press fit of said plug in said passage.

11. An end closure as in claim 8, wherein said rotor is of a plastic material.

12. An end closure as in claim 8, wherein said plug and rotor are initially integral and an end of said plug is attached by a frangible web to said rotor web at an end of said stem passage with said plug in alignment with said passage for extension therein, said frangible web being adapted to break upon extension of said plug into said stem passage.

13. A method of pivotally connecting a rotor to a base to form an end closure for a container, wherein the base has a web portion with an opening and at least one dispensing aperture therein, the rotor has a web portion and a stem attached at one end to the rotor web, the stem has an axial passage of generally uniform diameter therethrough and through the rotor web and the free end of the stem is extendible through the opening in the base web and has a retainer of a diameter slightly greater than that of the base web opening for slidably engaging the base web along the periphery of the opening and retaining the base and rotor in close, superposed relationship, and the rotor has at least one opening in the rotor web alignable with the base web dispensing aperture when the rotor is pivoted about the axis of the stem, said method comprising the steps of moving the free end of the rotor stem and retainer through the base web opening to collapse the retainer and stem radially inwardly into the stem passage as the retainer enters and moves theough the opening and to allow the retainer and stem to expand radially outwardly upon the retainer exiting the opening and, after the retainer exits the base opening, inserting a plug into the stem passage to substantially completely fill the passage, without causing significant radially outward expansion of the stem and retainer, to prevent radially inward movement of the stem and retainer upon any attempt to withdraw the stem from the base opening.

14. A method as in claim 13, including the step of securing the plug in the stem passage.

15. A method as in claim 14, wherein said securing step comprises bonding the plug in the stem passage.

16. A method as in claim 14, wherein said securing step comprises inserting a plug, having a diameter slightly greater than that of the passage, into the passage for a right press fit of the plug in the passage.

17. A method as in claim 13, wherein the plug and rotor are initially integral and an end of the plug is attached by a frangible web to the rotor web at an end of the stem passage with the plug in alignment with the passage for extension therein, said inserting step comprising pressing the plug with a force sufficient to break the frangible web and move the plug into the stem passage.

18. An improved end closure having a base and a rotor pivotally connected to said base by a hub of said rotor extending through an opening in said base, said base and rotor having webs with respective dispensing apertures therein and said rotor dispensing aperture being alignable with said base dispensing aperture by pivotal movement of said rotor with respect to said base about the axis of said hub, said hub extending perpendicularly from said rotor web and having an axial passage therethrough and an annular flange therearound spaced from said rotor web, said annular flange having a diameter greater than that of said base opening and said hub, between said flange and rotor web, having a diameter less than that of said flange, said rotor being assembled on said base by pushing said hub and flange thereof through said base opening, said hub and flange collapsing radially inwardly into said hub passage as said flange is moved through said base opening and then returning radially outwardly as said flange moves out of said base opening, whereby said flange secures said rotor to said base with the two in close superposed relationship, wherein the improvement is characterized in that an end of a plug is initially integrally attached by a frangible web to said rotor at an end of said hub passage with said plug in alignment with said passage for extension therein, said frangible web being adapted to break upon extension of said plug into said hub passage, and said plug is extended into and substantially completely fills said hub passage of the assembled rotor and base to prevent radially inward collapse of the hub and flange upon any attempt to pull the rotor from the base.

19. An improved end closure as in claim 18, wherein said plug passage has a generally uniform diameter along its length.

20. An improved end closure as in claim 18, wherein said plug has a diameter slightly greater than that of said hub passage for a tight press fit of said plug in said passage.

21. A tamper resistant end closure for a container, comprising a base and a rotor pivotally connected to said base, said base having a web portion with an opening therein and means defining at least one dispensing aperture, said rotor having a web portion and a stem attached at one end to said rotor web, the free end of said stem extending through said opening in said base web, said stem free end having retaining means for slidably engaging said base web around the periphery of said opening and retaining said base and rotor in close, superposed relationship, said rotor having at least one opening in said rotor web alignable with said base dispensing aperture when said rotor is pivoted about the axis of said stem, said stem having an axial passage therethrough and through said rotor web to accommodate radially inwardly movement of said stem and retaining means as the same are extended through said base opening to connect said rotor to said base, said rotor also having a plug initially integrally attached by a frangible web to said rotor web at an end of said stem passage with said plug in alignment with said passage for extension therein, said frangible web being adapted to break upon extension of said plug into said stem passage, and said plug being extended into and substantially completely filling said stem passage of said assembled rotor and base to prevent radially inward movement of said stem and retaining means upon any attempt to pull said stem out of said base opening, thereby to prevent disconnection of said rotor from said base.

22. An end closure as in claim 21, wherein said stem passage has a generally uniform diameter along its length and said plug has a diameter slightly greater than that of said stem passage for a tight press fit of said plug in said passage.

23. A method of pivotally connecting a rotor to a base to form an end closure for a container, wherein the base has a web portion with an opening and at least one dispensing aperture therein, the rotor has a web portion and a stem attached at one end to the rotor web, the stem has an axial passage therethrough and through the rotor web and the free end of the stem is extendible through the opening in the base web and has a retainer of a diameter slightly greater than that of the base web opening for slidably engaging the base web along the periphery of the opening and retaining the base and rotor in a close, superposed relationship, and the rotor has a plug initially integrally attached by a frangible web to the rotor web at an end of the stem passage and in alignment with the passage for extension therein, and at least one opening in the rotor web is alignable with the base web dispensing aperture when the rotor is pivoted about the axis of the stem, said method comprising the steps of moving the free end of the rotor stem and retainer through the base web opening to collapse the retainer and stem radially inwardly into the stem passage as the retainer enters and moves through the opening and to allow the retainer and stem to expand radially outwardly upon the retainer exiting the opening and, after the retainer exits the base opening, pressing the plug with a force sufficient to break the frangible web and move the plug into the stem passage to substantially completely fill the passage to prevent radially inward movement of the stem and retainer upon any attempt to withdraw the stem from the base opening.

24. A method as in claim 23, including the step of securing the plug in the stem passage.

25. A method as in claim 24, wherein the stem passage has a generally uniform diameter along its length and said securing step comprises press fitting the plug into the stem passage.

* * * * *